US009074159B2

(12) United States Patent
Zink et al.

(10) Patent No.: US 9,074,159 B2
(45) Date of Patent: Jul. 7, 2015

(54) PROCESS FOR IMPROVING A RE-REFINED LUBE OIL STREAM

(75) Inventors: Steven F. Zink, Westmont, IL (US); Tom Kalnes, LaGrange, IL (US); Mark VanWees, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 478 days.

(21) Appl. No.: 12/898,881

(22) Filed: Oct. 6, 2010

(65) Prior Publication Data

US 2012/0088702 A1 Apr. 12, 2012

(51) Int. Cl.

| | |
|---|---|
| ***C10G 69/02*** | (2006.01) |
| ***C10M 175/00*** | (2006.01) |
| ***C10G 45/10*** | (2006.01) |
| ***C10G 45/52*** | (2006.01) |
| ***C10G 65/04*** | (2006.01) |
| ***C10G 65/08*** | (2006.01) |

(52) U.S. Cl.

CPC . *C10M 175/0041* (2013.01); *C10M 2203/1025* (2013.01); *C10G 45/10* (2013.01); *C10G 45/52* (2013.01); *C10G 65/04* (2013.01); *C10G 65/08* (2013.01); *C10G 2300/1007* (2013.01); *C10G 2400/10* (2013.01)

(58) Field of Classification Search

CPC .. C10G 2300/302; C10G 45/00; C10G 45/02; C10G 45/44; C10G 45/52; C10G 65/02

USPC ..... 208/179–180, 18, 46

See application file for complete search history.

(56) References Cited

U.S. PATENT DOCUMENTS 3,673,078 A * 6/1972 Kirk, Jr. ..... 208/89
4,431,523 A 2/1984 Tabler et al.
5,397,459 A * 3/1995 Butler ..... 208/179
5,462,650 A 10/1995 Takito et al.
5,643,440 A 7/1997 Borghard et al.
5,855,767 A 1/1999 Powers et al.

(Continued)

FOREIGN PATENT DOCUMENTS

EP 2009084 A1 12/2008
WO 9718278 5/1997

OTHER PUBLICATIONS

Kalnes, T., et al., High quality base oil production via the HyLube process, AIChE Annual Meeting, Conference Proceedings, 2008, 2008 AIChE Spring National Meeting, Conference Proceedings Conference: 2008 AIChE Spring National Meeting, Conference, Apr. 6, 2008-Apr. 10, 2008.

Hennico, A., et al., Hydrocracking for high-viscosity, high-VI lube [lubricating oil] base stocks, Hydrocarbon Technology International (ISSN 0952-1399) 35-38 (1994).

(Continued)

*Primary Examiner* — Michelle Stein

(57) ABSTRACT

Embodiments of a process for improving a re-refined lube oil stream are provided. The process comprises the steps of introducing a gas stream comprising hydrogen ($H_2$) and the re-refined lube oil stream comprising hydroprocessed used lube oil to a hydrogenation reactor that contain Group VIII catalyst. A gas to oil feed ratio rate of from about 30 to about 100 $Nm^3$ $H_2/m^3$ is used to introduce the streams to the reactor. The hydroprocessed used lube oil is hydrogenated with the $H_2$ in the reactor such that an effluent is formed containing hydrogenated re-refined lube oil having about 2 wt. % or less of aromatics and about 55 wt. % or less of naphthenes. The reactor is operating at a temperature of from about 250 to about 300° C.

19 Claims, 5 Drawing Sheets

(56) References Cited

U.S. PATENT DOCUMENTS

| | | | | |
|---|---|---|---|---|
| 5,904,838 | A * | 5/1999 | Kalnes et al. | 208/179 |
| 7,132,043 | B1 | 11/2006 | Duprey et al. | |
| 7,686,949 | B2 | 3/2010 | McCarthy et al. | |
| 8,173,009 | B2 * | 5/2012 | Kalnes | 208/18 |
| 2005/0006282 | A1 * | 1/2005 | Grandvallet et al. | 208/179 |
| 2005/0194288 | A1 | 9/2005 | Holland et al. | |
| 2007/0062847 | A1 | 3/2007 | Hyde et al. | |
| 2009/0223862 | A1 * | 9/2009 | MacDonald | 208/184 |
| 2010/0200458 | A1 | 8/2010 | Kalnes | |

OTHER PUBLICATIONS

Guo, Q., et al., Influence of aromatics content in hydrotreating feedstock on lube base oil quality, Petroleum Processing and Petrochemicals, v 32, n. 5, p. 47-50, May 2001.

Peeters, "Deep hydrodenitrogenation on Pt supported catalysts in the presence of H2S, comparison with NiMo sulfide catalyst", Studies in Surface Science and Catalysis 130, A. Corma, F.V. Melo, S. Mendioroz and J.L.G. Fierro (Editors), 2000, Elsevier Science B.V., pp. 2837-2842.

* cited by examiner

PROCESS FOR IMPROVING A RE-REFINED LUBE OIL STREAM

FIELD OF THE INVENTION

The present invention generally relates to processes for treating a hydrocarbon stream, and more particularly relates to processes for treating a re-refined oil stream for improving its properties, e.g., to serve as a lubricant for a machine.

BACKGROUND OF THE INVENTION

Generally, it is desirable to recycle and reprocess used petroleum based products, such as waste lubricating oils, or oil derived from carbonaceous waste. Reprocessing or re-refining can recover a substantial amount of product from spent lubricants and other carbonaceous waste materials in an environmentally safe manner.

High severity hydroprocessing may be used to produce highly saturated, hetero-atom free oils that can be used as either finished or intermediate products, such as for example, lube oil blending stocks, petrochemical feedstocks, and specialty oils in liquid transportation fuels. Technology that is used for re-refining used or waste lubricating oils often needs improvements to adapt to changing feedstocks to include nontraditional sources of hydrocarbons.

Sometimes it is desirable to upgrade or enhance the hydrotreated or hydroprocessed used lube oil (e.g. re-refined lube oil). Particularly, oils can be segregated and defined by different grades, and higher grade products can have higher saturated content (e.g. low aromatic content) with preferably lower naphthene and higher linear and branched paraffin contents, which improves certain properties of the products. As a result, higher grade products, which are commercially desirable, can be made. Unfortunately, facilities that are designed to manufacture re-refined lube oil products at certain grades often do not provide higher quality products with low aromatic content and relatively low naphthene and high linear and branched paraffin contents.

Accordingly, it is desirable to provide processes that enhance a re-refined lube oil stream to provide an improved quality product that has a low aromatic content and relatively low naphthene and high linear and branched paraffin contents. Furthermore, other desirable features and characteristics of the present invention will become apparent from the subsequent detailed description of the invention in the appended claims, taken in conjunction with the accompanying drawings and this background of the invention.

SUMMARY OF THE INVENTION

Processes for treating a hydrocarbon stream for improving its properties are provided herein. In accordance with an exemplary embodiment, a process for improving a re-refined lube oil stream is provided. The process comprises the steps of introducing a gas stream comprising hydrogen ($H_2$) and the re-refined lube oil stream comprising hydroprocessed used lube oil to a hydrogenation reactor containing Group VIII catalyst. The gas and oil streams are introduced at a gas to oil feed ratio rate of from about 30 to about 100 $Nm^3$ $H_2/m^3$ to the hydrogenation reactor. The hydroprocessed used lube oil is hydrogenated with the $H_2$ in the hydrogenation reactor operating at hydrogenation conditions such that an effluent is formed containing hydrogenated re-refined lube oil that has about 2 wt. % or less of aromatics and about 55 wt. % or less of naphthenes. The hydrogenation conditions include a reactor temperature of from about 250 to about 300° C.

In accordance with another exemplary embodiment, a process for improving a re-refined lube oil stream comprises the steps of feeding a gas stream comprising hydrogen ($H_2$) and the re-refined lube oil stream to a hydrogenation reactor containing Group VIII catalyst. The gas and oil streams are feed at a gas to oil feed ratio rate of from about 30 to about 100 $Nm^3$ $H_2/m^3$ to the hydrogenation reactor. The hydrogenation reactor is at hydrogenation conditions such that an effluent is formed containing hydrogenated re-refined lube oil that has 2 wt. % or less of aromatics and about 55 wt. % or less of naphthenes. The hydrogenation conditions include a reactor temperature of from about 250 to about 300° C., an operating pressure of from about 1000 to about 1500 psig, and a liquid hourly space velocity of from about 0.5 to about 2.0 $hr^{-1}$. The hydrogenated re-refined lube oil is separated from the effluent.

In accordance with a further exemplary embodiment, a process for producing a Group III API rated lubricant from a re-refined lube oil stream is provided. The process comprises the steps of introducing a gas stream comprising hydrogen ($H_2$) and the re-refined lube oil stream comprising hydroprocessed used lube oil to a hydrogenation reactor containing Group VIII catalyst. The gas and oil streams are introduced at a gas to oil feed ratio rate of from about 30 to about 55 $Nm^3$ $H_2/m^3$ to the hydrogenation reactor. The hydroprocessed used lube oil is hydrogenated with the $H_2$ in the hydrogenation reactor operating at hydrogenation conditions such that an effluent is formed containing hydrogenated re-refined lube oil that has about 1 wt. % or less of aromatics and about 53 wt. % or less of naphthenes. The hydrogenation conditions include a reactor temperature of from about 270 to about 290° C., an operating pressure of from about 1000 to about 1500 psig, and a liquid hourly space velocity of from about 0.5 to about 2.0 $hr^{-1}$.

BRIEF DESCRIPTION OF THE DRAWINGS

The present invention will hereinafter be described in conjunction with the following drawing figures, wherein like numerals denote like elements, and wherein.

DETAILED DESCRIPTION

Figure 1:
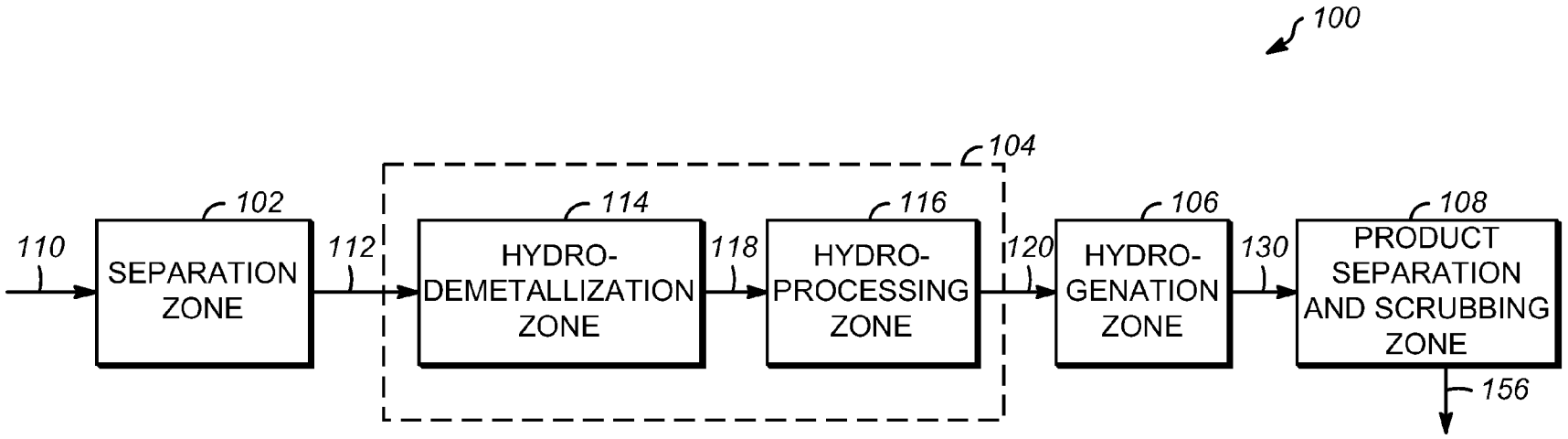
FIG. 1 schematically illustrates a system for producing a re-refined lube oil stream and for improving and/or upgrading the stream's properties in accordance with an exemplary embodiment.

The following Detailed Description is merely exemplary in nature and is not intended to limit the invention or the application and uses of the invention. Furthermore, there is no intention to be bound by any theory presented in the preceding background of the invention or the following detailed description of the invention.

The various embodiments contemplated herein relate to processes for improving a re-refined lube oil stream. The improved re-refined lube oil stream preferably is a higher grade product having relatively low aromatic content and thus, relatively high saturated content, with relatively low naphthene and high linear and branched paraffin content. The process comprises introducing a hydrogen ($H_2$) rich gas stream and a re-refined lube oil stream into one or more hydrogenation reactors containing a Group VIII catalyst. (As used herein, the term "rich" can mean an amount of generally at least about 50%, by mole, of a compound or class of compounds in a stream; and as used herein, the term "about" means within typical processing tolerances). The gas and oil streams are introduced to the one or more reactors at a relatively low gas to oil feed ratio rate. The re-refined lube oil is then hydrogenated with $H_2$ in the one or more reactors at a temperature that may be slightly increased to provide a hydrogenated re-refined lube oil having less than about 2 weight percent (wt. %) of aromatics (e.g. greater than about 98 wt. % saturates) and less than about 55 wt. % of naphthenes. Naphthenes are saturated cyclo-compounds including cycloalkanes, such as for example, cyclopentane, cyclohexane and their alkyl derivatives. In one example, the total non-cyclic paraffin content or total linear and branched paraffin content of the hydrogenated re-refined lube oil is at least about 45 wt. %.

The inventors have found that by reducing the amount of available $H_2$ with a slight increase in reactor temperature for hydrogenation, the re-refined lube oil experiences greater ring opening of the naphthene saturates, thereby decreasing the naphthene content and increasing the linear and branched paraffin content. Decreasing the naphthene content and increasing linear and branched paraffin content of hydrogenated re-refined lube oil preferably increases its viscosity index and improves the cold flow properties by decreasing the oil's cloud point and pour point. These properties are important in determining the quality of the lubricant and the American Petroleum Institute (API) grade or group to which the lubricant belongs. In particular, oils having a viscosity index of at least about 120, a saturates level greater than 90 wt. %, and a sulfur content of less than 0.03 wt. %, are considered a Group III API rated lubricant. Having a Group III API rated lubricant with a relatively low cloud point and pour point is particularly desirable because the lubricant will maintain flowability even at relatively low temperatures and may be blended in higher ratios (e.g. up to about 9:1) with virgin lube oils to form a high grade quality recycled blended lubricant. Such lubricants can for example be used in internal combustion engines for the automotive and marine industries or any other suitable application and/or industry.

Referring to FIG. 1, a schematic depiction of an exemplary lube oil manufacturing system 100 in accordance with an exemplary embodiment of the present invention is provided. The system 100 includes a separation zone 102, a hydrotreatment zone 104, a hydrogenation zone 106 and a product separation and scrubbing zone 108. As depicted, process flow lines in the figures can be referred to as lines, pipes, streams, effluents, oils, liquids, or gases. Moreover, a line or a pipe can contain one or more streams, effluents, oils, liquids, and/or gases.

A used oil stream 110 is provided to the separation zone 102. The separation zone 102 may include one or more equipment items and/or one or more sub-zones for removal of heavy non-distillable components or other undesirable components from the used oil stream 110 to provide a feed 112 to the hydrotreatment zone 104. For example, the separation zone 102 may include a flash separator and/or a vacuum stripper and/or heaters, coolers, re-circulated gas streams including re-circulated $H_2$, exchangers, pipes, pumps, compressors, and controllers as may be needed to pre-condition the used lube oil for subsequent processing in the hydrotreatment zone 104. It will be recognized by those skilled in the art that there are various suitable configurations for a separation zone which may be used. An exemplary configuration for one such suitable separation zone is disclosed in U.S. Patent Application publication number 2010/0200458, filed Feb. 6, 2009, and is hereby incorporated by reference in its entirety.

The feed 112 typically contains $H_2$ and hydrocarbons for processing in the hydrotreatment zone 104. The hydrotreatment zone 104 can include any number and type of hydrotreating sub-zones, and corresponding equipment items and reactors, such as a hydrodemetallization sub-zone 114, which includes for example a hydrodemetallization reactor, and a hydroprocessing sub-zone 116, which includes for example a hydroprocessing reactor. The reactors from the sub-zones 114 and 116 may, independently, contain one or more fixed, fluidized, or ebullated reactor catalyst beds.

The feed 112 is passed to the hydrodemetallization sub-zone 114 and contacted with a hydrodemetallization catalyst in the corresponding reactor at hydrodemetallization conditions to generate an effluent 118. Preferably, the hydrodemetallization catalyst is an inorganic oxide material, which can include porous or non-porous catalyst materials of silica, alumina, titania, zirconia, carbon, silicon carbide, silica-alumina, diatomaceous earth, clay, magnesium, activated carbon, combinations thereof, and/or a molecular sieve. Also, the hydrodemetallization catalyst may contain one or more metals from the Groups VIB and/or VIII of the periodic table. Other suitable catalyst for hydrodemetallization known to those skilled in the art may be used.

The hydrodemetallization reaction conditions can include a temperature of from about 150 to about 450° C., and a pressure of from about 100 to about 14,000 kPa, preferably of from about 790 to about 12,500 kPa. Generally, the reaction conditions include a gas to oil feed ratio rate of from about 33.7 to about 16,850 $Nm^3$ $H_2/m^3$, preferably of from about 50.5 to about 16,850 $Nm^3$ $H_2/m^3$, based on the feed 112 and the liquid hourly space velocity (LHSV) of from about 0.05 to about 20 $hr^{-1}$.

Suitably, the reaction is conducted with a maximum catalyst temperature in the range selected to perform the desired hydrodemetallization conversion to reduce undesirable components. It is contemplated that the desired demetallization can include dehalogenation, desulfurization, denitrification, olefin saturation, removal of organic phosphorus and organic silicon, and oxygenate conversion.

The effluent 118 is passed to the hydroprocessing sub-zone 116 and is contacted with a hydroprocessing catalyst in the corresponding reactor at hydroprocessing conditions to increase the hydrogen content in the hydrocarbons. Generally, the hydrogen reacts with the hydrocarbons to remove sulfur compounds, to perform deep denitrification and hydrodeoxygenation of the hydrocarbons, and to saturate aromatic compounds to form for example naphthenes.

Suitably, the reaction is conducted with a catalyst temperature in the range selected to perform the desired hydroprocessing conversion or to reduce undesirable components. The hydroprocessing reaction conditions can include a temperature of from about 200 to about 450° C., and a pressure of from about 100 to about 14,000 kPa. The reaction conditions can include a gas to oil feed ratio rate of from about 33.7 to about 16,850 $Nm^3$ $H_2/m^3$, preferably of from about 50.5 to about 16,850 $Nm^3$ $H_2/m^3$, based on the feed 118 and the LHSV of from about 0.05 to about 20 $hr^{-1}$. The preferred composition of the hydroprocessing catalyst disposed within the hydroprocessing reactor can generally be characterized as containing one or more metals from the Groups VIB and/or VIII of the periodic table.

Preferably, the processing conditions are at a temperature and under sufficient hydrogen partial pressure that some hydrocracking of the larger hydrocarbon molecules may occur. Generally, the corresponding reactor for the hydroprocessing zone 116 is operated at hydroprocessing conditions to produce re-refined lube oil stream 120 comprising hydroprocessing used lube oil. The re-refined lube oil stream 120 usually can have an effective amount of one or more saturated C5-C50, preferably C15-C30, hydrocarbons for lubricating a machine, such as at least about 85 wt. %, preferably at least about 90 wt. % saturated hydrocarbons and no more than about 300 ppm, by weight, sulfur based on the weight of the re-refined lube oil stream 120. In addition, the re-refined lube oil stream 120 may have a viscosity index of about 115 for example. The re-refined lube oil stream 120 can be effective as a lubricant and may exceed a Group II API rating, but typically not a Group III API rating.

It will be recognized by those skilled in the art that there are various suitable configurations for the hydrotreatment zone 104. An exemplary configuration for one such suitable hydrotreatment zone, which includes suitable sub-zone configurations, processing conditions and catalyst for the hydrodemetallization zone and the hydroprocessing zone, is disclosed in U.S. Patent Application publication number 2010/0200458, which has been incorporated herein by reference in its entirety. The re-refined lube oil stream 120 may be subsequently cooled (e.g., by a cooling water exchanger) prior to introduction to the hydrogenation zone 106 for further processing.

Figure 2:
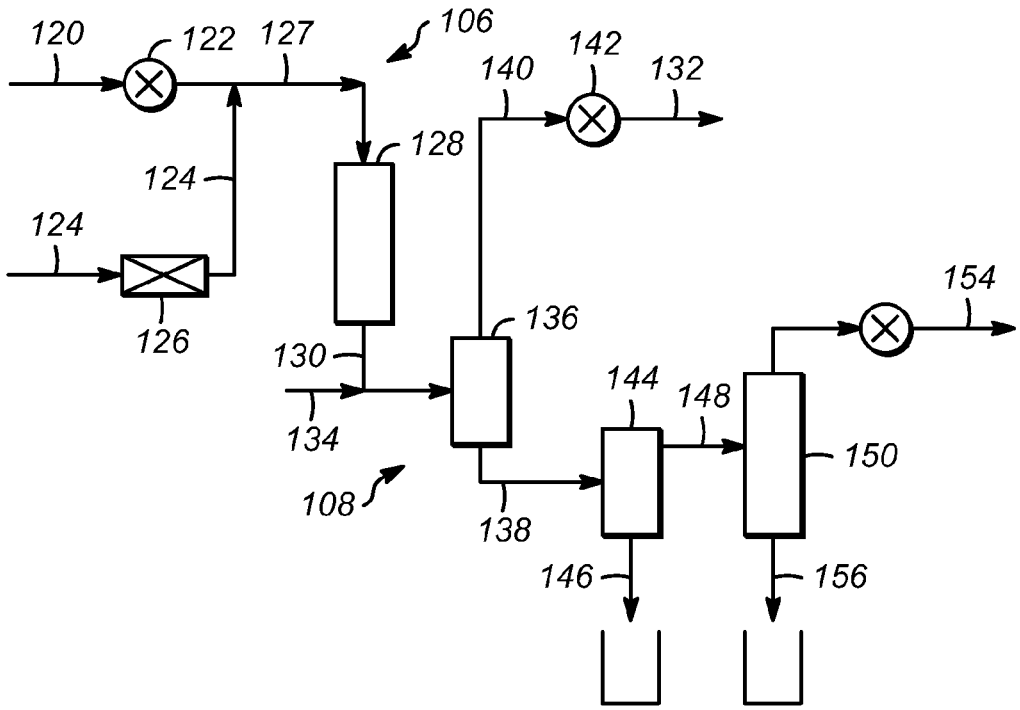
FIG. 2 is a schematic depiction of a hydrogenation zone and separation zone in accordance with an exemplary embodiment.
Figure 3:
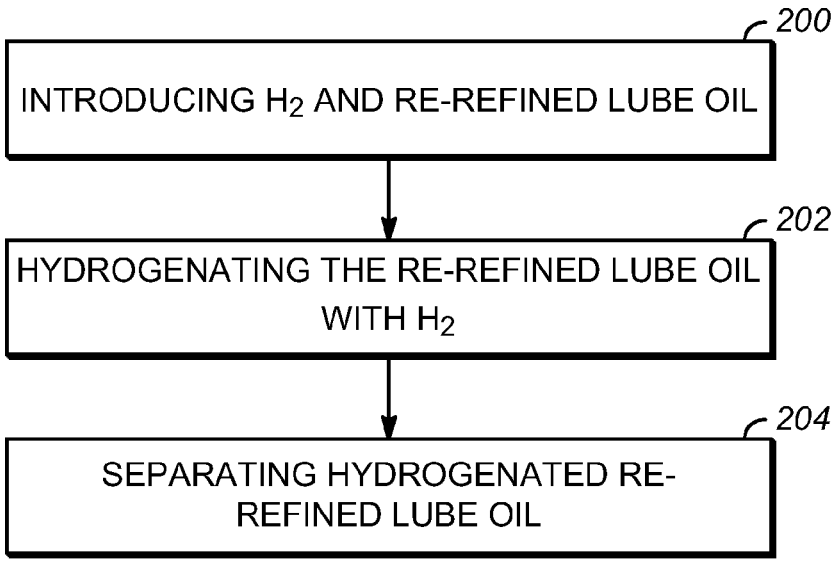
FIG. 3 is a flowchart of a process for improving a re-refined lube oil stream in accordance with an exemplary embodiment.

In an exemplary embodiment and also with reference to FIGS. 2 and 3, the re-refined lube oil stream 120 passes by a mass flow sensor 122 and is combined with a gas stream 124 that is rich in $H_2$ and that has passed by a thermal mass flow meter 126. The flow monitoring devices 122 and 126 monitor the two streams 120 and 124 so that the two streams 120 and 124 are introduced (step 200) to at least one hydrogenation vessel 128 via line 127 at a predetermined gas to oil feed ratio rate. The hydrogenation vessel 128 can be a single hydrogenation reactor or a plurality of hydrogenation reactors in parallel and/or series flow. The hydrogenation vessel 128 can include, independently, one or more fixed, fluidized, or ebullated catalyst beds. In one exemplary embodiment, the predetermined gas to oil feed ratio rate has a relatively low partial pressure of $H_2$ and is from about 30 to about 100 $Nm^3$ $H_2/m^3$. Preferably, the gas to oil feed ratio rate is from about 30 to about 60 $Nm^3$ $H_2/m^3$, and more preferably is from about 35 to about 50 $Nm^3$ $H_2/m^3$.

The hydrogenation vessel 128 contains a Group VIII hydrogenating catalyst that comprises one or more metals selected from Group VIII of the periodic table. Preferred metals include one or more noble metals having a strong hydrogenation function, especially platinum, palladium and mixtures thereof. The mixture of metals may also be present as a bulk metal catalyst where the amount of metal is 30 wt. % or greater based on the catalyst. The metals referred to are preferably not in an oxide state. Supports for the metals include low acidic oxides such as silica, alumina, silica-alumina or titania, preferably alumina. The preferred hydrogenating catalyst for aromatics saturation comprises one or more metals having relatively strong hydrogenation function on a porous support. Typical support materials include amorphous or crystalline oxide materials such as alumina, silica, and silica-alumina. The metal content of the catalyst is often as high as about 20 wt. % for non-noble metals. Noble metals are usually present in amounts no greater than about 2 wt. %.

The hydroprocessed used lube oil of the re-refined lube oil stream 120 is hydrogenated with the $H_2$ (step 202) in the hydrogenation vessel 128 having one or more hydrogenation reactors operating at hydrogenation conditions such that an effluent steam 130 is formed containing hydrogenated re-refined lube oil that has about 2 wt. % or less of aromatics and about 55 wt. % or less of naphthenes. More preferably, the hydrogenated re-refined lube oil has about 1.0 wt. % or less of aromatics, about 53 wt. % or less of naphthene and about 45 wt. % or greater of total linear and branched paraffins.

In an exemplary embodiment, the hydrogenation conditions for the one or more hydrogenation reactors of the hydrogenation vessel 128 include a reactor temperature of from about 250 to about 300° C., more preferably of from about 265 to about 290° C., and most preferably of from about 270 to about 290° C. The hydrogenation conditions may further include an operating pressure of from about 1000 to about 1500 psig, which can be monitored and controlled via a control valve 142 that releases the bleed gas stream 132. A liquid hourly space velocity (LHSV) of from about 0.5 to about 2.0 $hr^{-1}$ is preferably used for operating the one or more hydrogenation reactors of the hydrogenation vessel 128.

Although not wanting to be bound by theory, typical reactions may include aromatics saturation, normal paraffin isomerization, and naphthene ring opening. In particular, the inventors have found that by using a relatively low partial pressure of $H_2$ gas in combination with the hydrogenation catalyst and reactor temperature as discussed in the foregoing paragraphs, naphthene ring opening is increased over current processes. Moreover, by operating the one or more hydrogenation reactors of the hydrogenation vessel 128 under such low $H_2$ partial pressure condition, the hydrogenation zone 106 may be operated with a "once through" approach for the hydrogenated re-refined liquid product and the $H_2$ gas, allowing the gas to be either exhausted or redirected to another zone for other plant usage for overall improved system efficiency.

In an exemplary embodiment, the effluent stream 130 is passed to the product separation and scrubbing zone 108 for separation of the hydrogenated re-refined lube oil from the effluent (step 204). Initially, the effluent stream 130 is combined with a scrubbing solution stream 134 to quench the effluent stream 130 before entering the high-pressure separator 136. The contact with the scrubbing solution stream 134 can be performed in any convenient manner, including in-line mixing. The scrubbing solution stream 134 can remove acidic gases and ammonia in the effluent stream 130. The scrubbing solution preferably can include a basic compound such as sodium carbonate, ammonium hydroxide, potassium hydroxide and mixtures thereof in an aqueous solution that may neutralize and dissolve water-soluble inorganic compounds. In one example, the caustic aqueous solution stream 134 comprises from about 3 wt. % to about 15 wt. % KOH.

The combined streams 130 and 134 are passed to the high pressure separator 136 where they mix and separate into a spent scrubbing stream 138 and a gas stream 140 that is rich in $H_2$, methane, ethane, propane and hydrogen sulfide ($H_2S$). The gas stream 140 is advanced through the control valve 142 and exits the system 100 as the bleed gas stream 132. The spent scrubbing stream 138 is passed to an oil water separator 144 which separates the stream 138 into a spent caustic stream 146 for removal from the system 100, and a hydrogenated hydrocarbon stream 148. The hydrogenated hydrocarbon stream 148 is sent to a stripper 150 for removal of $H_2S$ and liquefied petroleum gas (LPG) as flash gas 154, and to produce a liquid product stream 156 comprising the hydrogenated re-refined lube oil.

In the above hydrogenated re-refined lube oil, the saturates content can be measured by ASTM D-2007 (2001), the viscosity index can be measured by DIN ISO 2909 (2002) and ASTM D-2270 (2004), cloud point by ASTM D-2500, and pour point by ASTM D-6300. In one exemplary embodiment, the hydrogenated re-refined lube oil has a viscosity index of at least about 120, preferably of at least about 125, a cloud point of about −4° C. or less, and the pour point of about −7° C. or less. Preferably, the hydrogenated re-refined lube oil is a Group III API rated lubricant.

The following is an example including some product test data of hydrogenated re-refined oil produced in a pilot plant test where the hydrogenation reactors were operated at various hydrogenation conditions. The example is provided for illustration purposes only and is not meant to limit the various embodiments of the process for improving a re-refined lube oil stream in any way.

Example

Pilot Plant Test Run

The pilot plant test run utilized a hydrogenation zone and separation zone similarly configured to hydrogenation zone 106 and product separation and scrubbing zone 108 illustrated in FIG. 2. The pilot plant test run used a "once through" approach where the liquid oil product and the $H_2$ gas were not recycled. The hydrogenation vessel was configured as 4-filled bed flow reactors in parallel packed with Group VIII catalyst. The 4 reactors were contained in a common salt bath and were packed with fresh catalyst such that isothermal conditions in the reactors were maintained through operation.

The pilot plant test run consisted of a total of 29 tests correspondingly run over 29 days (29—Days On Stream, hereinafter "DOS", corresponding to 29—tests) where each test period was typically about 16 hours with about an 8 hours line-out period between tests. During the first 18 days, tests 1-18 were conducted under substantially identical gas to oil feed ratio rates and reactor temperatures. During the remaining days, tests 19-29 where conducted as a variable study using different gas to oil feed ratio rates and reactor temperatures. In all cases, the gas feed was essentially pure $H_2$, and the oil feed was from the same blended batch of re-refined lube oil having a Group II API rating. Specifically, the blended batch of re-refined lube oil had about 7.4 wt. % aromatics (determined by solvent extraction of aromatics in a $SiO_2$ column and HRMS) and a viscosity index of about 117.9. The following table indicates the hydrogenation conditions used for each of the reactors (e.g. R1, R2, R3, R4):

TABLE 1

| Test Period (DOS) | Pressure, bar(g) | Fresh Feed Rate, cc/h | LHSV, $hr^{-1}$ R1, R2, R3, R4 | $H_2$ to Oil Gas Rate, $Nm^3$ $H_2/m^3$ | Reactor Temperatures, (° C.) |
|---|---|---|---|---|---|
| 1-11 | 82.8 | 135 | 0.75 | 843 | 260 |
| 12-18 | 82.8 | 144 | 0.80 | 843 | 260 |
| 19-22 | 82.8 | 144 | 0.80 | 93 | 260 |
| 23-26 | 82.8 | 144 | 0.80 | 59 | 266, 268 |
| 27-29 | 82.8 | 144 | 0.80 | R1 = 45<br>R2 = 37 | 279 |

As illustrated in Table 1, for test periods 1-18 the reactors were operated at a relatively high $H_2$ partial pressure corresponding to a gas to oil ratio rate of about 843 $Nm^3$ $H_2/m^3$ and reactor temperatures about 260° C. For test periods 19-22, the reactors were operated at relatively lower $H_2$ partial pressure corresponding to a gas to oil ratio rate of about 93 $Nm^3$ $H_2/m^3$ and reactor temperatures about 260° C. For test periods 23-26 and 27-29, the $H_2$ partial pressure was further lowered to a gas to oil ratio rate of about 59 $Nm^3$ $H_2/m^3$ and about 37-45 $Nm^3$ $H_2/m^3$, respectively, while the reactor temperatures were correspondingly increased to about 266 to about 279° C. The effluent streams were then separated and scrubbed under substantially identical conditions for all test periods to produce corresponding hydrogenated re-recycled lube oil products, which were subsequently tested.

Figure 4:
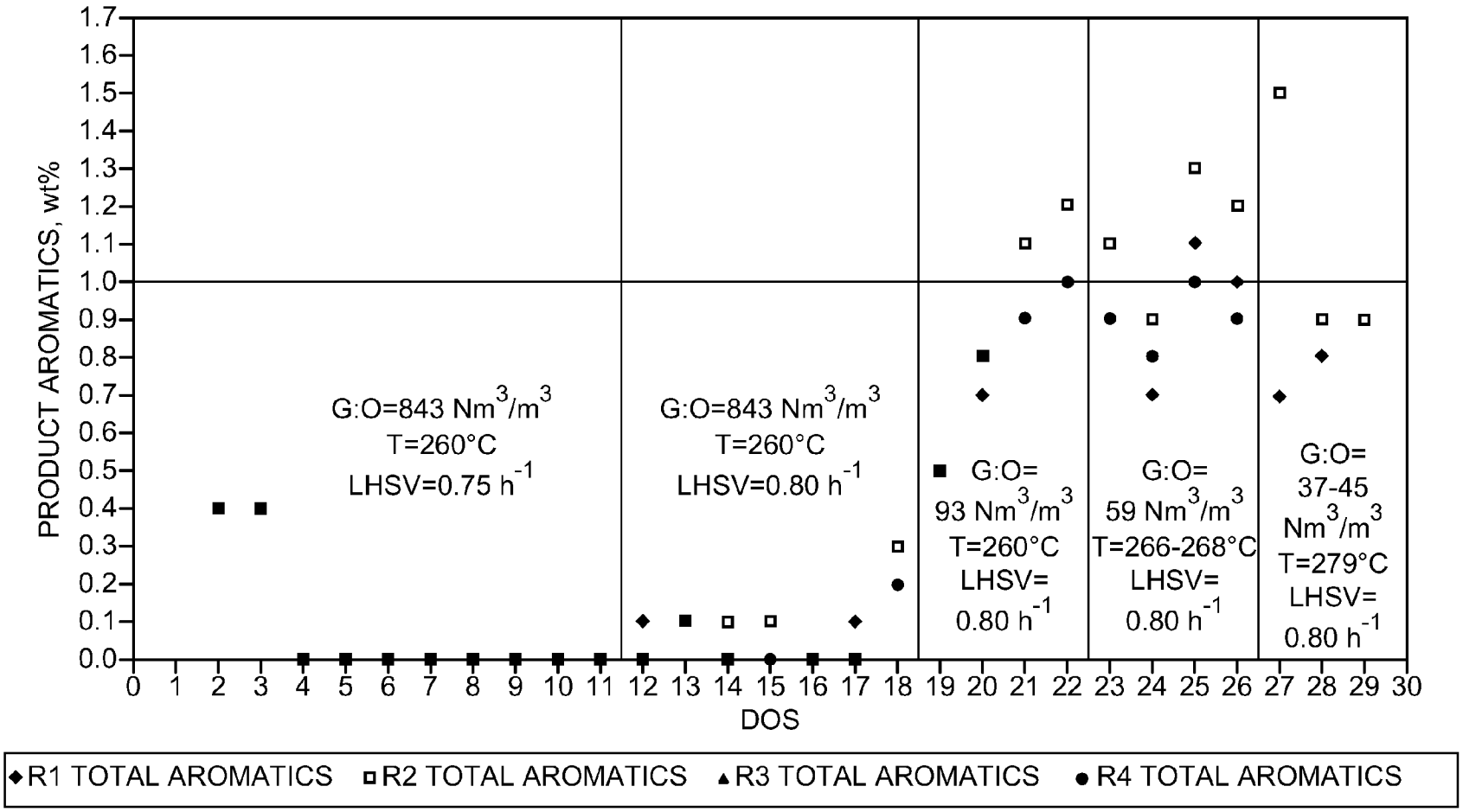
FIG. 4 is a graphic representation of product aromatics by weight percent for products produced in a pilot plant test run in accordance with an exemplary embodiment.

Referring to FIG. 4, a graphical depiction of product total aromatics by wt. % (y-axis), as determined by solvent extraction of aromatics in a $SiO_2$ column and high-resolution mass spectroscopy (hereinafter "HRMS"), and DOS (x-axis) are provided, where "◆" indicates R1 Total Aromatics, "□" indicates R2 Total Aromatics, "▲" indicates R3 Total Aromatics, "●" indicates R4 Total Aromatics. As indicated, products produced during 1-18 DOS had relatively very low weight percentages of aromatics, which were well below the target of about 1.0 wt. %. Product produced during 19-29 DOS had relatively low weight percentages of aromatics acceptably near the target of about 1.0 wt. %, and in several cases substantially less than the target of about 1.0 wt. %.

Figure 5:
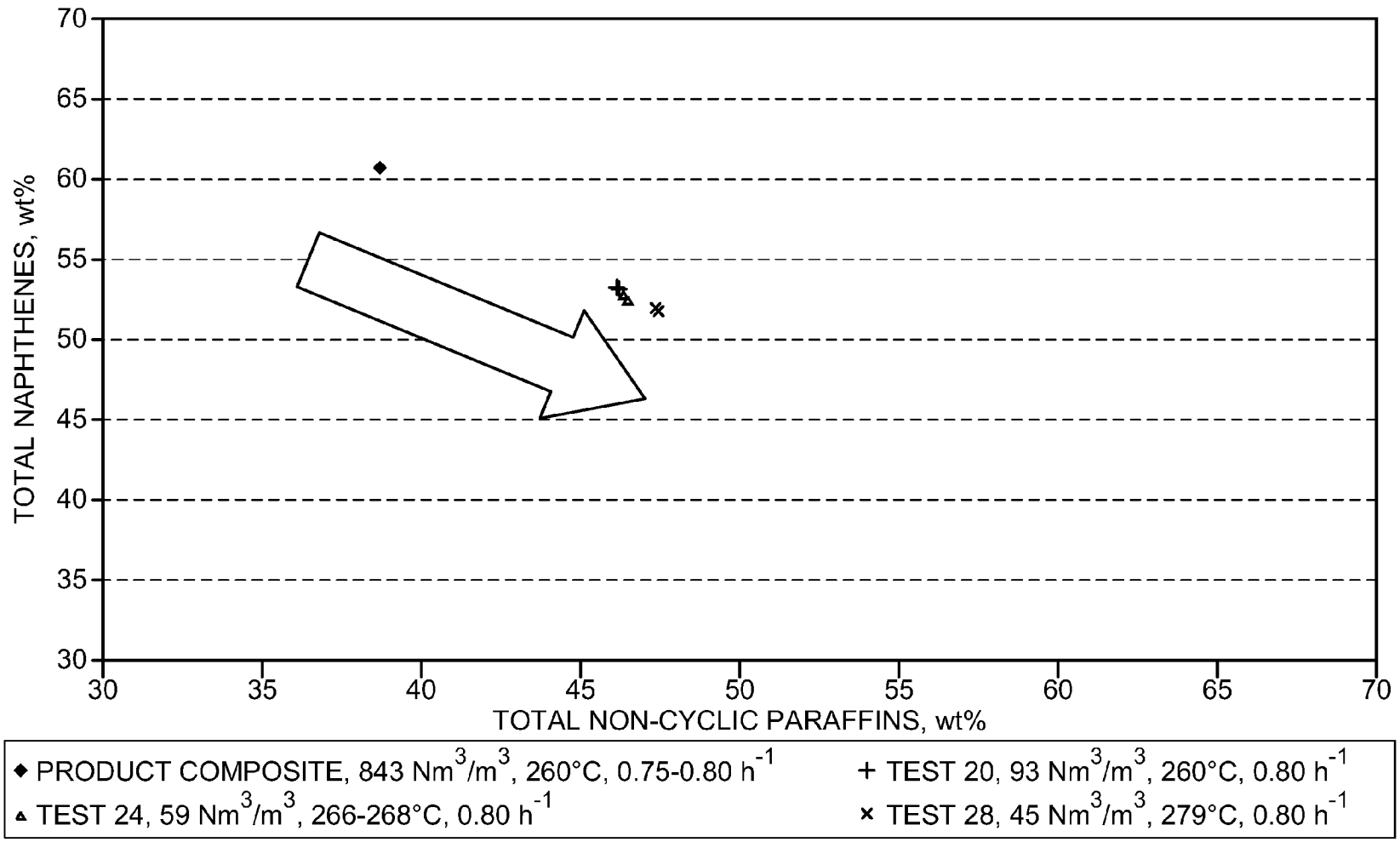
FIG. 5 is a graphic representation of total naphthenes by weight percent for products produced in the pilot plant test run associated with FIG. 4.

Referring to FIG. 5, a graphical depiction of product dearomatization ring opening performance for total naphthenes by wt. % (y-axis) versus total non-cyclic paraffins (i.e. total linear and branched paraffins) by wt. % (x-axis), as determined by two-dimensional gas chromatography-gas chromatography analysis (GC-GC), for the product composite of product produced during 1-18 DOS and further, for the products produced during 20, 24 and 28 DOS are provided. Specifically, "◆" indicates Product Composite, 843 $Nm^3$ $H_2/m^3$, 260° C., 0.75-0.80 $h^{-1}$, "Δ" indicates Test 24, 59 $Nm^3$ $H_2/m^3$, 266-268° C., 0.80 $h^{-1}$, "+" indicates Test 20, 93 $Nm^3$ $H_2/m^3$, 260° C., 0.80 $h^{-1}$, "x" indicates Test 28, 45 $Nm^3$ $H_2/m^3$, 279° C., 0.80 $h^{-1}$. As indicated, the product composite corresponding to 1-18 DOS had greater than 60 wt. % of naphthenes and less than 40 wt. % of total linear and branched paraffins. However, the products corresponding to 20, 24 and 28 DOS all had about 53 wt. % or less of naphthenes and greater than about 45 wt. % of total linear and branched paraffins indicating a significant increase in ring opening performance of the naphthenes to produce a significant increase in total linear and branched paraffins content over products produced during 1-18 DOS.

As indicated earlier, it is believed that decreasing the levels of naphthenes by ring opening, which increases the total linear and branched paraffin content, significantly improves certain properties of re-refined lube oil. In particular, the cold flow properties including the cloud point and pour point significantly improved for the samples measured of products produced during 19-29 DOS, especially during 27-29 DOS, versus products produced during 1-18 DOS. The cloud point and pour point for the products produced during 27-29 DOS were of from about −6 to about −7° C. and of about −9° C., respectively, compared with from about −3 to about −3.5° C. and of about −6° C., respectively, for the products produced during 1-18 DOS.

Figure 6:
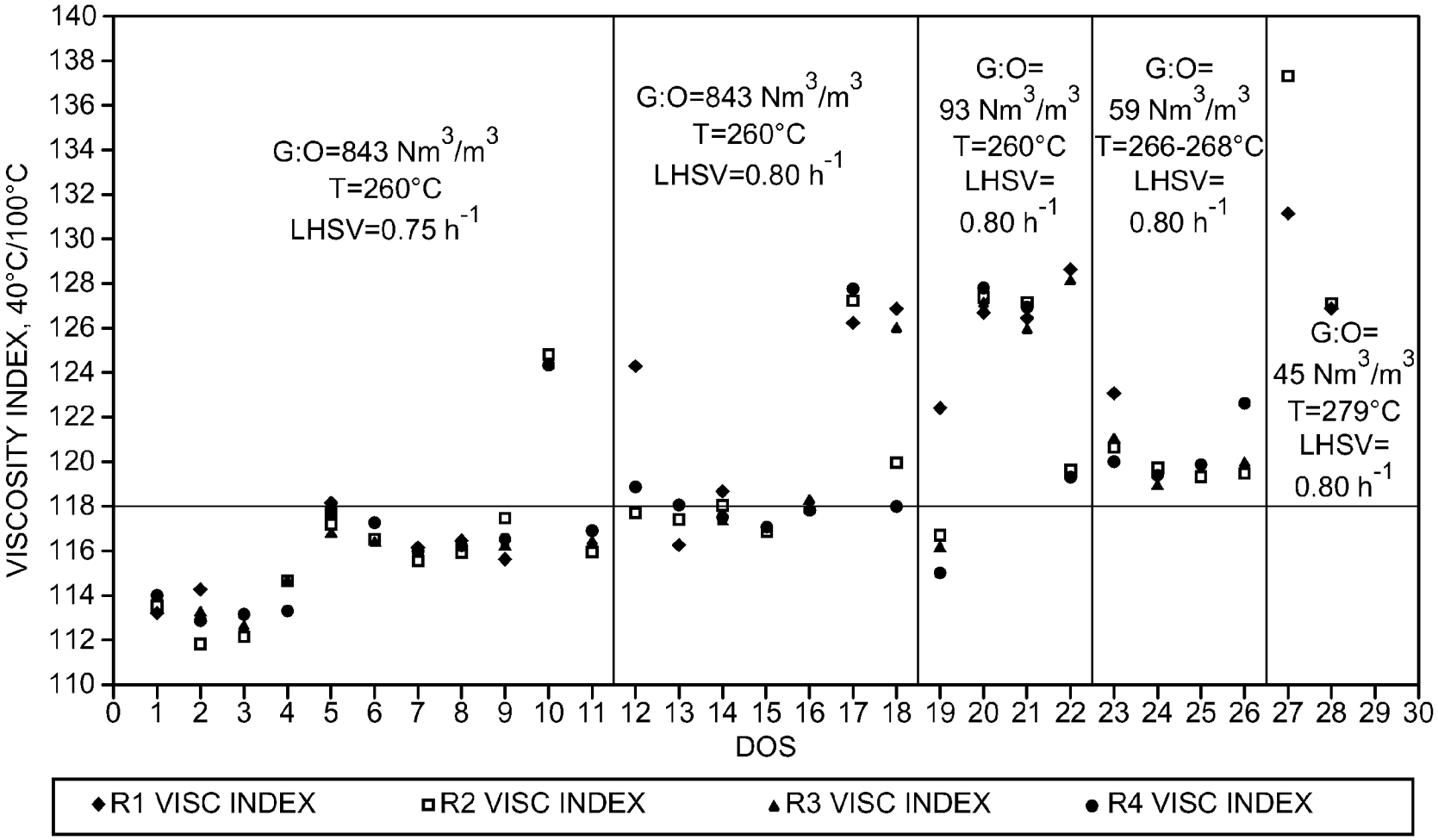
FIG. 6 is a graphic representation of viscosity indexes for products produced in the pilot plant test run associated with FIG. 4.

Referring to FIG. 6, a graphical depiction of the viscosity indexes @ 40° C./100° C. (y-axis) for the products produced during 1-28 DOS (x-axis) are provided, where "◆" indicates R1 Viscosity Index, "□" indicates R2 Viscosity Index, "▲"

indicates R3 Viscosity Index, "●" indicates R4 Viscosity Index. As indicated, most of the products produced correspondingly during 1-18 DOS had viscosity indexes of about 118 or less, whereas most of the products produced during 19-28 DOS had viscosity indexes of greater than about 118. In particular, the products produced during 27-28 DOS had viscosity indexes of from about 126 to about 138.

Accordingly, processes for improving a re-refined lube oil stream have been described. The various embodiments of the processes comprise introducing a $H_2$ rich gas stream and a re-refined lube oil stream to one or more hydrogenation reactors containing Group VIII catalyst. The gas and oil streams are introduced to the one or more reactors at a relatively low gas to oil feed ratio rate. The re-refined lube oil stream is then hydrogenated with $H_2$ in the one or more reactors at temperatures that may be slightly increased to provide hydrogenated re-refined lube oil having less than about 2 wt. % of aromatics and less than about 55 wt. % of naphthenes. By hydrogenating the re-refined lube oil under such hydrogenation conditions, greater ring opening of the naphthene saturates can be achieved thereby increasing the total linear and branched paraffin content to produce an improved re-refined lube oil that is preferably a Group III API rated lubricant.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A process for improving a re-refined lube oil stream, the process comprising the steps of:

processing a feed stream in a hydrotreatment zone to provide the re-refined lube oil stream;

introducing a gas stream comprising hydrogen ($H_2$) and the re-refined lube oil stream comprising no more than about 300 ppm, by weight, sulfur to a hydrogenation reactor containing Group VIII catalyst comprising a metal selected from the group consisting of platinum, palladium, and mixtures thereof at a gas to oil feed ratio rate of from about 30 to about 100 $Nm^3$ $H_2/m^3$; and hydrogenating the re-refined lube oil stream with the $H_2$ in the hydrogenation reactor operating at hydrogenation conditions such that an effluent is formed containing hydrogenated re-refined lube oil that has about 2 wt. % or less of aromatics, about 55 wt. % or less of naphthenes, and a viscosity index of at least about 120, the hydrogenation conditions including a reactor temperature of from about 250 to about 300° C.

2. The process of claim 1, wherein the hydrogenation conditions include an operating pressure of from about 1000 to about 1500 psig.

3. The process of claim 1, wherein the hydrogenation conditions include a liquid hourly space velocity of from about 0.5 to about 2.0 $hr^{-1}$.

4. The process of claim 1, wherein the gas to oil feed ratio rate is about 60 $Nm^3$ $H_2/m^3$ or less.

5. The process of claim 1, wherein the reactor temperature is from about 265 to about 290° C.

6. The process of claim 1, wherein the hydrogenated re-refined lube oil has about 1 wt. % or less of the aromatics.

7. The process of claim 1, wherein the hydrogenated re-refined lube oil has about 53 wt. % or less of the naphthenes.

8. The process of claim 1, wherein the hydrogenated re-refined lube oil has about 45 wt. % or more of total paraffins.

9. The process of claim 1, wherein the hydrogenated re-refined lube oil is a Group III API rated lubricant.

10. The process of claim 1, wherein the hydrogenated re-refined lube oil has a cloud point of about −4° C. or less, and a pour point of about −7° C. or less.

11. A process for improving a re-refined lube oil stream, the process comprising the steps of:

feeding a gas stream comprising hydrogen ($H_2$) and the re-refined lube oil stream comprising no more than about 300 ppm, by weight, sulfur to a hydrogenation reactor containing a Group VIII catalyst at a gas to oil feed ratio rate of about 60 $Nm^3$ $H_2/m^3$ or less, the hydrogenation reactor at hydrogenation conditions such that an effluent is formed containing hydrogenated re-refined lube oil that has about 2 wt. % or less of aromatics, about 55 wt. % or less of naphthenes, and a viscosity index of at least about 120, the hydrogenation conditions including a reactor temperature of from about 250 to about 300° C. and a liquid hourly space velocity of from about 0.5 to about 2.0 $hr^{-1}$; and separating the hydrogenated re-refined lube oil from the effluent.

12. The process of claim 11, wherein the reactor temperature is from about 265 to about 290° C.

13. The process of claim 11, wherein the hydrogenated re-refined lube oil has about 1 wt. % or less of the aromatics.

14. The process of claim 11, wherein the hydrogenated re-refined lube oil has one of about 53 wt. % or less of the naphthenes and of about 45 wt. % or more of total paraffins.

15. The process of claim 11, wherein the Group VIII catalyst comprises metal selected from the group consisting of platinum, palladium, and mixtures thereof.

16. The process of claim 11, wherein the hydrogenated re-refined lube oil is a Group III API rated lubricant.

17. The process of claim 1 for producing a Group III API rated lubricant from a re-refined lube oil stream, wherein said effluent is formed containing hydrogenated re-refined lube oil that has about 1 wt. % or less of aromatics and about 53 wt. % or less of naphthenes, the hydrogenation conditions including a reactor temperature of from about 270 to about 290° C., an operating pressure of from about 1000 to about 1500 psig, and a liquid hourly space velocity of from about 0.5 to about 2.0 $hr^{-1}$.

18. The process of claim 1, wherein processing the feed stream in a hydrotreatment zone comprises passing the feed stream through a hydrodemetallization zone and a hydroprocessing zone.

19. A process for improving a re-refined lube oil stream, the process comprising the steps of:

processing a feed stream in a hydrotreatment zone to provide the re-refined lube oil stream;

introducing a gas stream comprising hydrogen ($H_2$) and the re-refined lube oil stream comprising no more than about 300 ppm, by weight, sulfur to a hydrogenation reactor containing Group VIII catalyst comprising a metal selected from the group consisting of platinum, palladium, and mixtures thereof and a support material comprising silica-alumina at a gas to oil feed ratio rate of from about 30 to about 100 $Nm^3$ $H_2/m^3$; and hydrogenating the re-refined lube oil stream with the $H_2$ in the hydrogenation reactor operating at hydrogenation conditions such that an effluent is formed containing hydrogenated re-refined lube oil that has about 2 wt. % or less of aromatics, about 55 wt. % or less of naphthenes, and a viscosity index of at least about 120, the hydrogenation conditions including a reactor temperature of from about 250 to about 300° C.

* * * * *